US007182670B2

(12) United States Patent
Muldowney

(10) Patent No.: US 7,182,670 B2
(45) Date of Patent: Feb. 27, 2007

(54) CMP PAD HAVING A STREAMLINED WINDOWPANE

(75) Inventor: Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/166,940

(22) Filed: Jun. 23, 2005

(65) Prior Publication Data

US 2006/0063471 A1 Mar. 23, 2006

Related U.S. Application Data

(63) Continuation-in-part of application No. 10/946,864, filed on Sep. 22, 2004, now abandoned.

(51) Int. Cl.
*B24B 49/12* (2006.01)

(52) U.S. Cl. ..... 451/6; 451/527

(58) Field of Classification Search ..... 451/6, 451/527, 533, 288, 287

See application file for complete search history.

(56) References Cited

U.S. PATENT DOCUMENTS

| | | | | |
|---|---|---|---|---|
| 5,486,129 | A * | 1/1996 | Sandhu et al. | 451/5 |
| 6,454,630 | B1 * | 9/2002 | Tolles | 451/6 |
| 6,752,690 | B1 | 6/2004 | Fruitman | |
| 2005/0060943 | A1 * | 3/2005 | Turner et al. | 51/297 |
| 2005/0245171 | A1 | 11/2005 | Hosaka et al. | |

* cited by examiner

*Primary Examiner*—Robert A. Rose
(74) *Attorney, Agent, or Firm*—Blake T. Biederman

(57) ABSTRACT

A chemical mechanical polishing pad (200, 300, 400, 500, 600) that includes a translucent windowpane (220, 320, 404, 516, 524, 604) that allows optical measurements to be made using light energy reflected from the surface of a wafer (212, 324, 608) or other object being polished. The windowpane includes a trailing end (350, 416, 632) and a leading end (348, 412, 628) each having a streamlined shape so as to reduce the disturbance to the flow of a polishing medium (216) around the windowpane. The polishing pad may further include grooves (336, 428, 520, 640) that are diverted around the windowpane so as to provide a continuous path for the polishing medium in the region of the windowpane.

9 Claims, 7 Drawing Sheets

CMP PAD HAVING A STREAMLINED WINDOWPANE

This application is a continuation-in-part of application Ser. No. 10/946,864 filed Sep. 22, 2004 now abandoned.

BACKGROUND OF THE INVENTION

The present invention generally relates to the field of polishing. In particular, the present invention is directed to a CMP pad having a streamlined windowpane.

In the fabrication of integrated circuits and other electronic devices, multiple layers of conducting, semiconducting and dielectric materials are deposited onto and etched from a surface of a semiconductor wafer. Thin layers of these materials may be deposited using any of a number of deposition techniques. Deposition techniques common in modern wafer processing include physical vapor deposition (PVD), also known as sputtering, chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the uppermost surface of the wafer becomes non-planar. Because subsequent semiconductor processing (e.g., photolithography) requires the wafer to have a flat surface, the wafer needs to be planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize workpieces, such as semiconductor wafers. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, each of the polishing pad and wafer is rotated about its respective center while the wafer is engaged with the polishing layer. The rotational axis of the wafer is offset relative to the rotational axis of the polishing pad by a distance greater than the radius of the wafer such that the rotation of the pad sweeps out a ring-shaped "wafer track" on the polishing layer of the pad. When the only movement of the wafer is rotational, the width of the wafer track is equal to the diameter of the wafer. However, in some dual-axis polishers, the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a polishing medium is flowed onto the polishing pad and into the gap between the wafer and polishing layer. The wafer surface is polished and made planar by chemical and mechanical action of the polishing layer and polishing medium on the surface.

An important aspect of CMP is determining when polishing should be stopped, i.e., when the polishing endpoint has been reached. Generally, polishing is stopped either when a desired surface profile, or degree of planarization, has been achieved or when a desired thickness of a layer has been removed. One method of detecting the endpoint of polishing is to identify when a desired layer has been polished off the wafer using optical techniques. One example of such optical techniques is described in U.S. Pat. No. 5,433,651 to Lustig et al. Generally, these optical endpoint detection techniques involve reflecting a light beam, e.g., laser beam, off of the wafer being polished, measuring the reflected light, and determining when the reflectance changes. A relatively abrupt change in reflectance often occurs when a layer having a first reflectance has just been polished away to expose another layer having a second reflectance different from the first reflectance.

Since CMP pads are typically opaque, CMP pads used in connection with optical measuring systems are often provided with various shaped translucent or semi-translucent windowpanes that allow a light beam to strike and reflect off of the wafer without moving the wafer away from the pad. The most common CMP pad windowpane shapes are blunt shapes, such as rectangular, circular and shapes having aspects of both circular and rectangular shapes. For example, U.S. Pat. No. 6,458,014 to Ishikawa et al. discloses a CMP pad that includes a rectangular windowpane. U.S. Pat. No. 6,537,133 to Birang et al. discloses a CMP pad that includes a circular windowpane and a CMP pad that includes an elongate arc-shaped slotted windowpane having semi-circular leading and trailing ends.

FIGS. 1A and 1B illustrate how the polishing medium flow in the gap between a wafer 100 and a conventional CMP pad 104 is affected by a rectangular-shape windowpane 108. In this case, CMP pad 104 includes a polishing surface 112 having a plurality of concentric, circular grooves 116, and windowpane 108 is rectangular in shape, with its long axis 120 located along a radius 124 of the pad. Although polishing surface 112 contains grooves 116, it is typically not practical to put grooves in windowpane 108 because such grooves, or the polishing debris that would collect in them, may scatter a light beam (not shown) shone through the windowpane and, consequently, confound the signal reaching an endpoint detector (not shown).

As clearly shown in FIG. 1B, the approaching polishing medium flow (as indicated by flow lines 128) within grooves 116 confronts a "leading" long side 132 of windowpane 108 and is essentially deflected around the windowpane. In addition to the polishing medium essentially backing up against windowpane 108 along leading long side 132, the polishing medium flow adjacent the short sides 136 of the windowpane is increased by the additional amount of polishing medium that would have flowed through the region at the windowpane had the window not been present. Finally, the flow of polishing medium immediately adjacent the trailing long side 140 of the window is greatly disturbed by the blockage created by the window because flow gathers inward behind the window from both short sides 136 and converges in a disorderly manner along trailing long side 140. Needless to say, the polishing medium flow in the entire region surrounding windowpane 108 is greatly disturbed by the presence of the windowpane. Although a small amount of polishing medium may traverse the top surface of the window in a very thin layer, the other disturbances to the flow are not reduced.

Generally, the greater the obstruction to the polishing medium flow resulting from the presence of a windowpane, such as windowpane 108, the greater the probability that the resulting flow disturbances will have a negative impact on the polishing process. This is so because the disturbed flow thwarts an even distribution of polishing medium chemistry and uniform temperature field, contributing to non-uniformity in point-to-point polishing rates across the wafer. In addition, the termination of many grooves at the edge of a blunt leading edge of a windowpane provides an opportunity for polish debris to accumulate, potentially leading to scratches and other defects.

None of the patents mentioned above, nor the designers of conventional CMP pad windowpanes appear to give much, if any, consideration to the effect of the plan-view shape of the windowpane on polishing nor the impact of the windowpane on polishing medium flow patterns in the pad-wafer gap, with the exception of flushness of the windowpane to the surrounding polishing surface. Consequently, what is needed is a polishing pad that has a windowpane and is designed to reduce the impact of the windowpane on polishing and on the disruption of polishing medium flow within the pad-wafer gap.

STATEMENT OF THE INVENTION

In one aspect of the invention, a polishing pad suitable for polishing at least one of magnetic, optical and semiconductor substrates, the polishing pad comprising: (a) a body having a polishing surface and a back surface spaced from the polishing surface; and (b) a window, extending through the body, comprising a translucent windowpane having a surface flush with the polishing surface and having a half-width leading angle of 5 to 150° and a half-width trailing angle of 5 to 45°.

In another aspect of the invention, a polishing pad suitable for polishing at least one of magnetic, optical and semiconductor substrates, the polishing pad comprising: (a) a body having a polishing surface and a back surface spaced from the polishing surface, the polishing surface comprising a plurality of grooves; and (b) a window, extending through the body, comprising a translucent windowpane having a surface flush with the polishing surface; wherein at least some of the plurality of grooves divert around the window.

DETAILED DESCRIPTION OF THE INVENTION

Figure 1A:
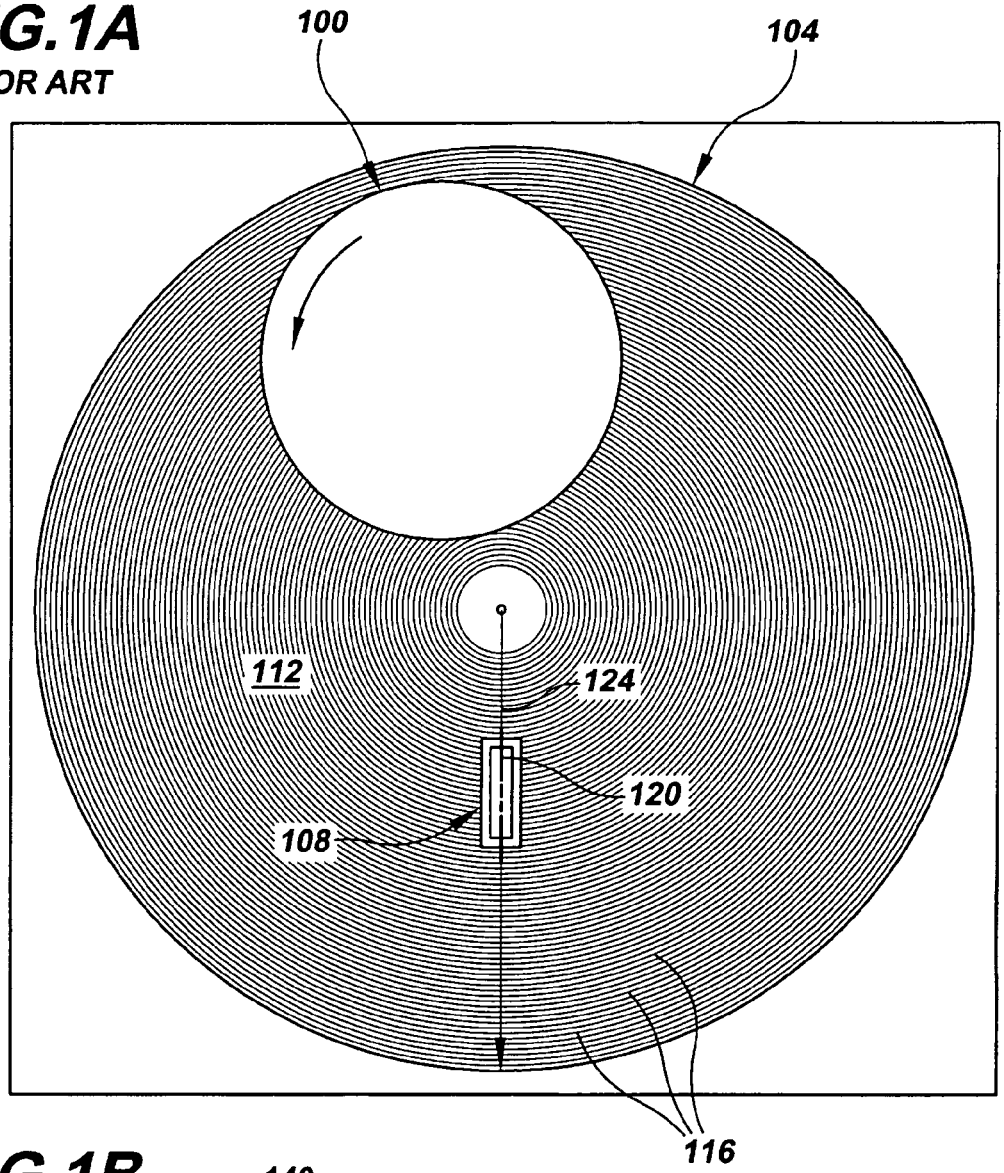
FIG.1A PRIOR ART
FIG. 1A is a plan view of a wafer engaging a prior art polishing pad having a windowpane.

Referring again to the drawings, FIG. 2 generally illustrates a polishing pad 200 of the present invention in use with a dual-axis (CMP) polisher 204 that may be used to polish a surface 208 (hereinafter referred to as "polished surface") of an article, such as wafer 212, in the presence of a polishing medium 216. Examples of other items that may be polished using polishing pad 200 include glass items, flat panel displays and magnetic information storage disks, among other workpieces. It is noted that for the sake of convenience, the term "wafer" is used below without the loss of generality. In addition, as used in this specification, including the claims, the term "polishing medium" includes particle-containing polishing solutions and non-particle-containing solutions, such as abrasive-free and reactive-liquid polishing solutions.

Polishing pad 200 is distinguished from prior art polishing pads by virtue of its inclusion of a windowpane 220 that is specifically shaped to reduce the impact of the windowpane on the flow of polishing medium 216 within the pad-wafer gap, i.e., the gap between polished surface 208 and a polishing layer 224 of the pad, in the region of the windowpane. By decreasing the impact of windowpane 220 on the flow of polishing medium 216 within the pad-wafer gap during polishing, any negative impact caused by the disturbed flow should likewise be decreased. The design of polishing pad 200 and windowpane 220 is described below in much more detail, following an overview of CMP polisher 204.

Polisher 204 includes an optical measuring system 228, e.g., an endpoint detector, that shines a beam of light (not shown) through window 220 so that the light beam strikes, and reflects back from, polished surface 208 of wafer 212 to the optical measuring system. As discussed in the Background section above, optical measuring systems suitable for use as optical measuring system 228 are well known in the art and, therefore, need not be described in any detail herein.

Polisher 204 may include a platen 232 that holds polishing pad 200 during polishing. Platen 232 is rotatable about a rotational axis 236 by a platen driver (not shown) and includes a window (not shown) or other opening that allows the light beam from optical measuring system 228 to reach, and return from, polished surface 208 via windowpane 220. Wafer 212 may be supported by a wafer carrier 240 that is rotatable about a rotational axis 244 parallel to, and spaced from, rotational axis 236 of platen 232. Wafer carrier 240 may feature a gimbaled linkage (not shown) that allows wafer 212 to assume an aspect very slightly non-parallel to polishing pad 200, in which case rotational axes 236, 244 may be very slightly askew. Wafer carrier 240 may be supported by a carrier support assembly (not shown) adapted to rotate wafer 212 and provide a downward force F to press polished surface 208 against polishing layer 224 so that a desired pressure exists between the polished surface and the polishing layer during polishing. Polisher 204 may also include a polishing medium inlet 248 for supplying polishing medium 216 to polishing layer 224.

As those skilled in the art will appreciate, polisher 204 may include other components (not shown) such as a system controller, polishing medium storage and dispensing system, heating system, rinsing system and various controls for controlling various aspects of the polishing process, such as: (1) speed controllers and selectors for one or both of the rotational rates of wafer 212 and polishing pad 200; (2) controllers and selectors for varying the rate and location of delivery of polishing medium 216 to the pad; (3) controllers and selectors for controlling the magnitude of force F applied between the wafer and pad, and (4) controllers, actuators and selectors for controlling the location of rotational axis 244 of the wafer relative to rotational axis 236 of the pad, among others. Those skilled in the art will understand how these components are constructed and implemented such that a detailed explanation of them is not necessary to understand and practice the present invention.

During polishing, polishing pad 200 and wafer 212 are rotated about their respective rotational axes 236, 244 and polishing medium 216 is dispensed from polishing medium inlet 248 onto the rotating polishing pad. Polishing medium 216 spreads out over polishing layer 224, including the gap between wafer 212 and polishing pad 200. Polishing pad 200 and wafer 212 are typically, but not necessarily, rotated at selected speeds between 0.1 rpm and 150 rpm. Force F is typically, but not necessarily, of a magnitude selected to induce a desired pressure of 0.1 psi to 15 psi (6.9 kPa to 103 kPa) between wafer 212 and polishing pad 200.

Figure 3A:
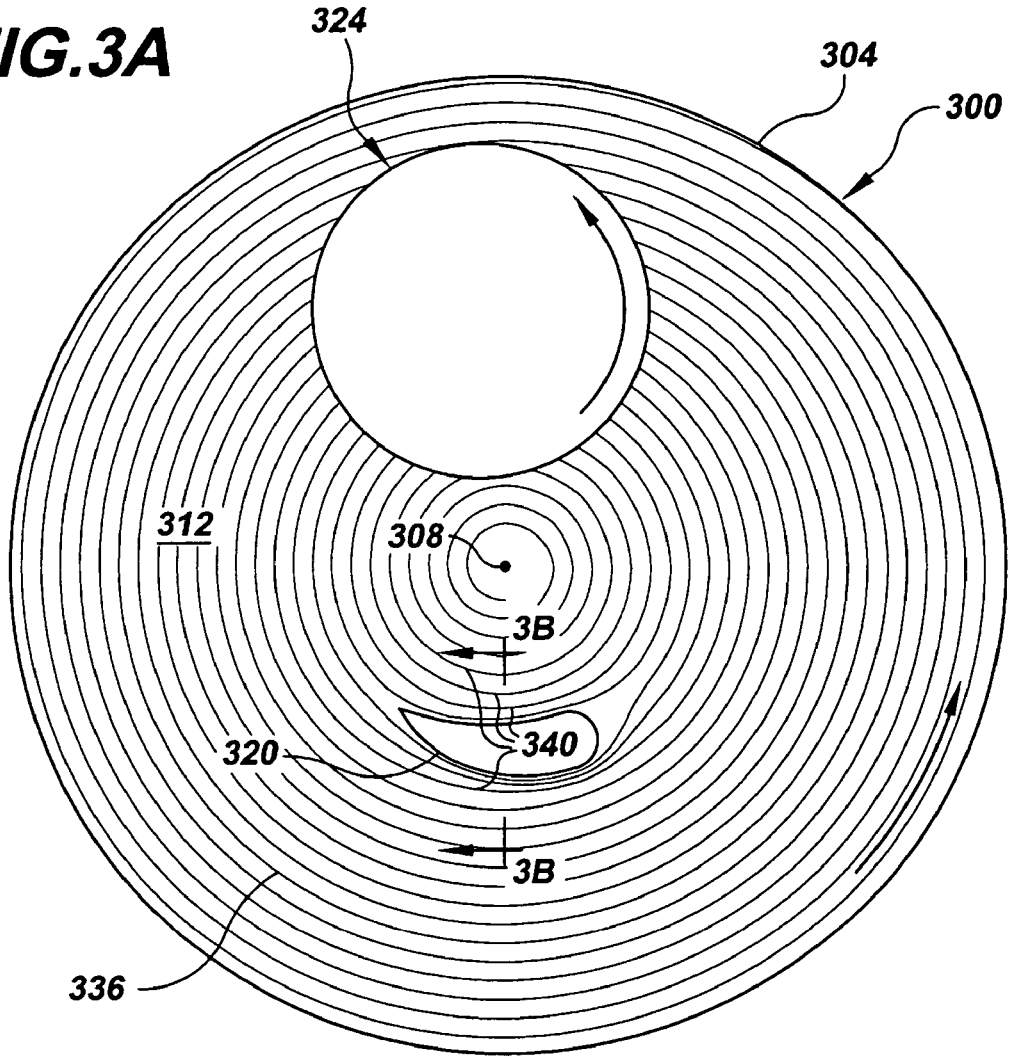
FIG. 3A is a plan view of a rotary polishing pad of the present invention.
Figure 3B:
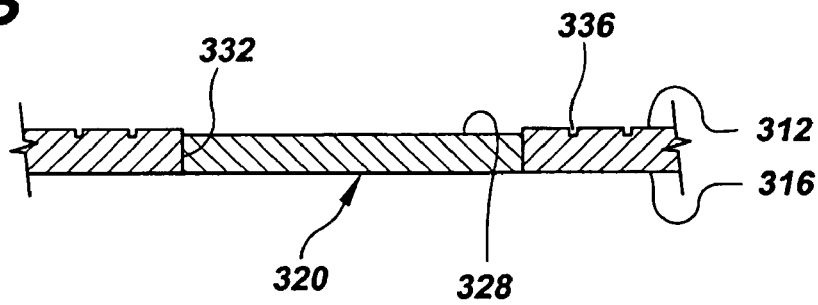
FIG. 3B is a cross-sectional view of the polishing pad of FIG. 3A as taken along line 3B—3B of FIG. 3A.
Figure 3C:
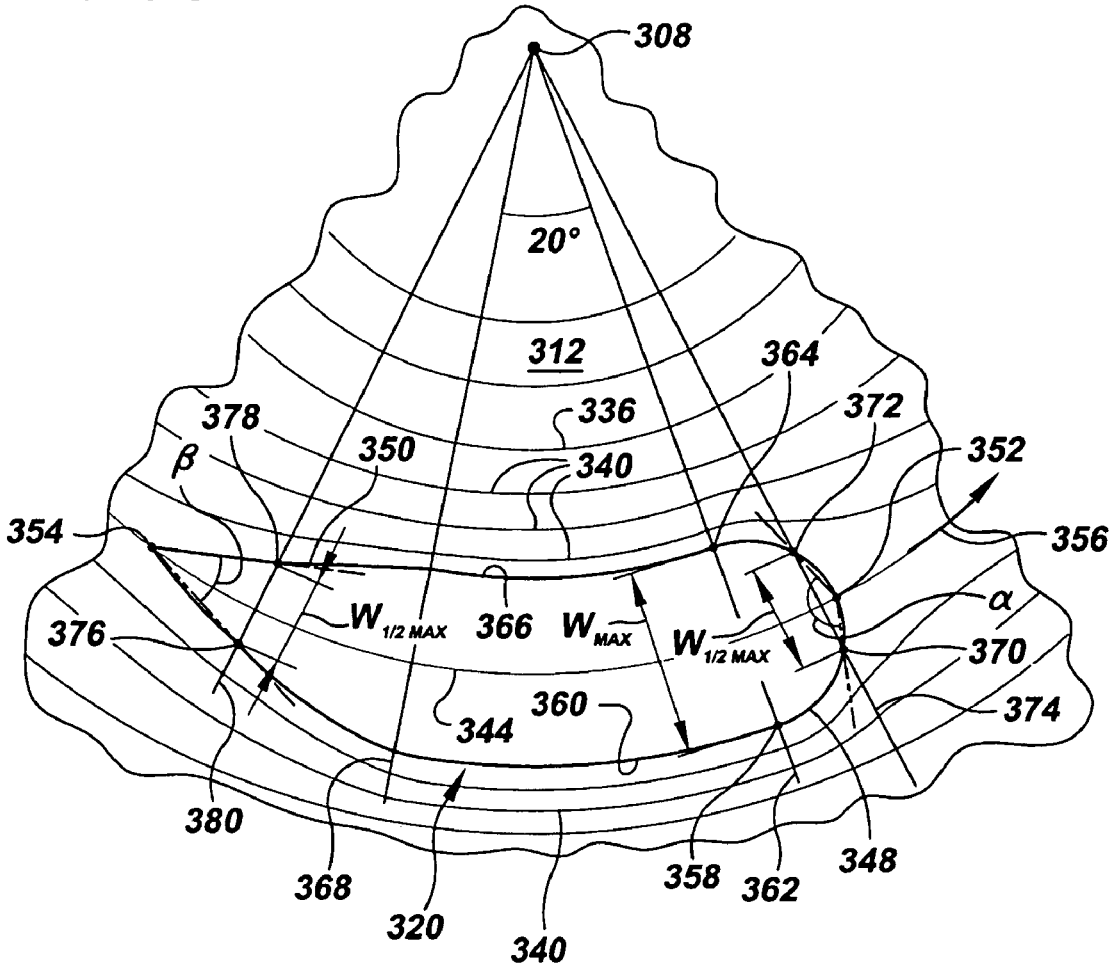
FIG. 3C is an enlarged plan view showing the windowpane of the polishing pad of FIG. 3A.

FIGS. 3A–3C illustrate a rotary polishing pad 300 suitable for use as polishing pad 200. Polishing pad 300 generally comprises a disc-shaped body 304 having a center of rotation 308. Body 304 includes a polishing surface 312 and a back surface 316 spaced from the polishing surface. Body 304 may be a single layer or may consist of a plurality of layers. Each layer may be made of any material(s) used to make conventional polishing pads, e.g., any one of a variety of polymer plastics, such as a polyurethane, polybutadiene, polycarbonate and polymethylacrylate, among many others. Those skilled in the art are knowledgeable of the many types of materials that may be used to make body 304, such that it is not necessary to provide a list for those skilled in the art to appreciate the broad scope of the present invention.

Polishing pad 304 further includes a windowpane 320 made of a translucent material, i.e., a material that allows light to be transmitted therethrough to an extent that optical measurements may be made on light reflected back from a wafer, e.g., wafer 324, as discussed above. Examples of translucent materials suitable for windowpane 320 include, among others, polyurethane, polycarbonate and polymethylacrylate. Windowpane 320 typically includes a surface 328 that is largely flush with, or very slightly recessed below, polishing surface 312 of body 304, at least during polishing. Since body 304 may include a material that is more compressible than the material used for windowpane 320, surface 328 of the windowpane may be recessed relative to polishing surface 312 when the material of the body is in a relaxed state, e.g., when wafer 324 is not being pressed against polishing pad 300.

Windowpane 320 may be incorporated into, or attached to, body 304 in any suitable manner. For example, in one embodiment, windowpane 320 and body 304 may be formed separately from one another and then attached to one another by adhesive bonding, chemical bonding, welding, etc. In such an embodiment, body 304 may be made either with an aperture, or window 332, for receiving windowpane 320 formed therein or without the window, which would later be made by cutting out a portion of the body. Whether formed originally into body 304 or cut into the body after forming, the sides of window 332 in the vertical dimension, i.e. through the thickness of body 304, may be vertical as shown in FIG. 3B, or alternately slanted, curved, stepped, or of any other profile (not shown) that facilitates the insertion and attachment of windowpane 320. In another embodiment, windowpane 320 may be formed integrally with body 304, e.g., by placing a preformed windowpane (or precursor thereto) into a mold and casting body material(s) around it. In this case, windowpane 320 would typically be secured to body 304 by fusion between the materials of the windowpane and body. The preformed windowpane or precursor may have straight vertical sides as implied by FIG. 3B or may alternately have a slanted, curved, stepped, or any other profile (not shown) that facilitates fusion between the materials of the windowpane and body and secure retention of the windowpane when the body is subjected to compression, bending, and other modes of deformation. Of course, those skilled in the art will appreciate that any suitable conventional method may be used to include windowpane 320 in polishing pad 300.

Body 304 may include one or more grooves located in polishing surface 312 for holding and conveying a polishing medium (not shown) during polishing. In the embodiment shown, polishing pad 300 has a single spiral groove 336 having several groove segments 340 that divert around windowpane 320 so as to provide continuous flow channels for the polishing medium to flow past the windowpane. Other groove configurations can be envisioned, e.g., circular configurations (such as seen in circular grooves 424 of FIG. 4), radial configurations, arcuate configurations, and regular pattern configurations forming isolated land regions (such as the hexagonal land regions of FIGS. 5A and 5B), among others.

Referring particularly to FIG. 3C, this figure illustrates various concepts that aid in describing the streamlined nature of windowpane 320. Since windowpane 320 is present in circular polishing pad 300 having a center of rotation 308 about which the pad is rotated during polishing, it is helpful to define a number of parameters relative to various lines radiating from the center of rotation in order to describe the configuration of the windowpane. Generally, this is so because when polishing pad 300 is rotating, windowpane 320 travels along a circular arc, e.g., central circular arc 344. Consequently, the primary movement of the polishing medium on polishing surface 312 is circular. Windowpane 320 generally includes two ends 348, 350 spaced from one another along the length of the windowpane, i.e., the dimension of the windowpane extending parallel to central circular arc 344. In this example, polishing pad 300 is particularly configured to be rotated in a counterclockwise direction, such that end 348 may be considered a "leading" end and end 350 may be considered a "trailing" end.

Windowpane 320 may be further considered to have a leading tip 352 and a trailing tip 354 that are, respectively, the point on leading end 348 that is forward-most relative to a direction of travel 356 and the point on trailing end 350 that is rearward most relative to the direction of travel. Windowpane 320 may also be considered to have a maximum width $W_{max}$, i.e., the maximum dimension between a point of intersection 358 between a radially outward edge 360 of the windowpane and a radial line 362 originating at center of rotation 308 and a point of intersection 364 between a radially inward edge 366 of the windowpane and this radial line. In the embodiment shown, maximum width $W_{max}$ occurs at any radial line within the 20° arc between radial line 362, which is located at the transition to leading end 348, and a radial line 368 located at the transition to trailing end 350. However, it is noted that this need not be so. In other embodiments, maximum width $W_{max}$ may occur at only one radial line or only several radial lines, depending upon the shape of windowpane 320.

With leading and trailing tips 352, 354 and maximum width $W_{max}$ defined, it is possible to characterize each of leading end 348 and trailing end 350 as either "streamlined" in accordance with the present invention or "not streamlined" using these definitions. In this connection, it is helpful to define a "half-width leading angle" $\alpha$ and a "half-width trailing angle" β. Half-width leading angle α is defined by three points, leading tip 352 and the two intersection points 370, 372 of radially outward edge 360 and radially inward edge 366 with a radial line 374 closest to the leading tip that provides a distance, or width $W_{1/2max}$, between points 370, 372 equal to one-half of maximum width $W_{max}$. Similarly, half-width trailing angle β is defined by three points, trailing tip 354 and the two intersection points 376, 378 of radially outward edge 360 and radially inward edge 366 with a radial line 380 closest to the trailing tip that provides width $W_{1/2max}$ between points 376, 378 equal to one-half of maximum width $W_{max}$.

Leading end 350 is semicircular in shape. For any semicircle, it can be shown with basic trigonometry that regardless of maximum width, the half-width angle will be 150°. A half-width angle of 150° is considered not highly streamlined, especially for a trailing end at which flow disturbances are more likely to negatively impact polishing due to the turbulence that typically forms in the region immediately downstream of a non-streamlined end of an object, e.g., windowpane 320, in a fluid flow path. Thus, for the purposes of the present invention, a half-width trailing angle β less of 45° or less is preferable. A half-width trailing angle of 40° or less is more preferable, and a half-width trailing angle of 30° or less is even more preferable. Of course, smaller half-width trailing angles (β) (and half-width leading angles (α)) are more desirable than larger such angles from the viewpoint of streamlined flow. However, from a practical viewpoint, trailing end 350 (and leading end 348) should not be too long. Otherwise, the benefits of streamlined flow of the polishing medium can be overshadowed by detrimental effects arising from windowpane 320 simply occupying too much of the polishing region of polishing surface 312.

The half-width leading angle α typically has an angle of 5 to 150°. Preferably, the half-width leading angle α has an angle of 10 to 120°. Most preferably, the half-width leading angle α has an angle of 15 to 45° with a rounded leading end. The half-width trailing angle β typically has an angle of 5 to 45°. Preferably, the half-width trailing angle β has an angle of 10 to 40°. Most preferably, the half-width trailing angle β has an angle of 15 to 30° with a rounded trailing end.

Figure 1B:
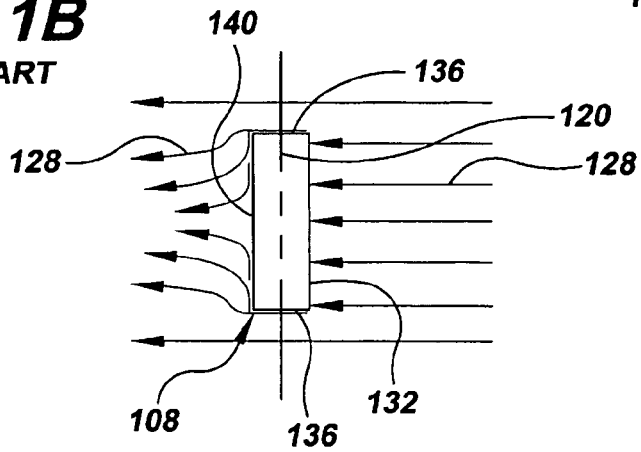
FIG.1B PRIOR ART
FIG. 1B is a schematic diagram illustrating the flow of polishing medium in the gap between the wafer and the polishing pad of FIG. 1A in a region of the windowpane during polishing.

Applying the concepts of half-width leading and trailing angles α, β to leading and trailing ends 348, 350 of windowpane 320 of FIG. 3C, it is seen that the half-width leading angle is 150° and the half-width trailing angle is 45°. As mentioned above, an angle of 150° would not be considered very streamlined for half-width trailing angle β of trailing end 350. However, for half-width leading angle α of leading end 348, an angle of 150° is at least acceptable. The semi-circular shape of leading end 348 certainly provides a more streamlined leading end than a straight edge of a rectangle presented perpendicular to the flow direction, such as is present in windowpane 108 of FIGS. 1A and 1B, and for which the half-width leading angle is 180°.

Figure 2:
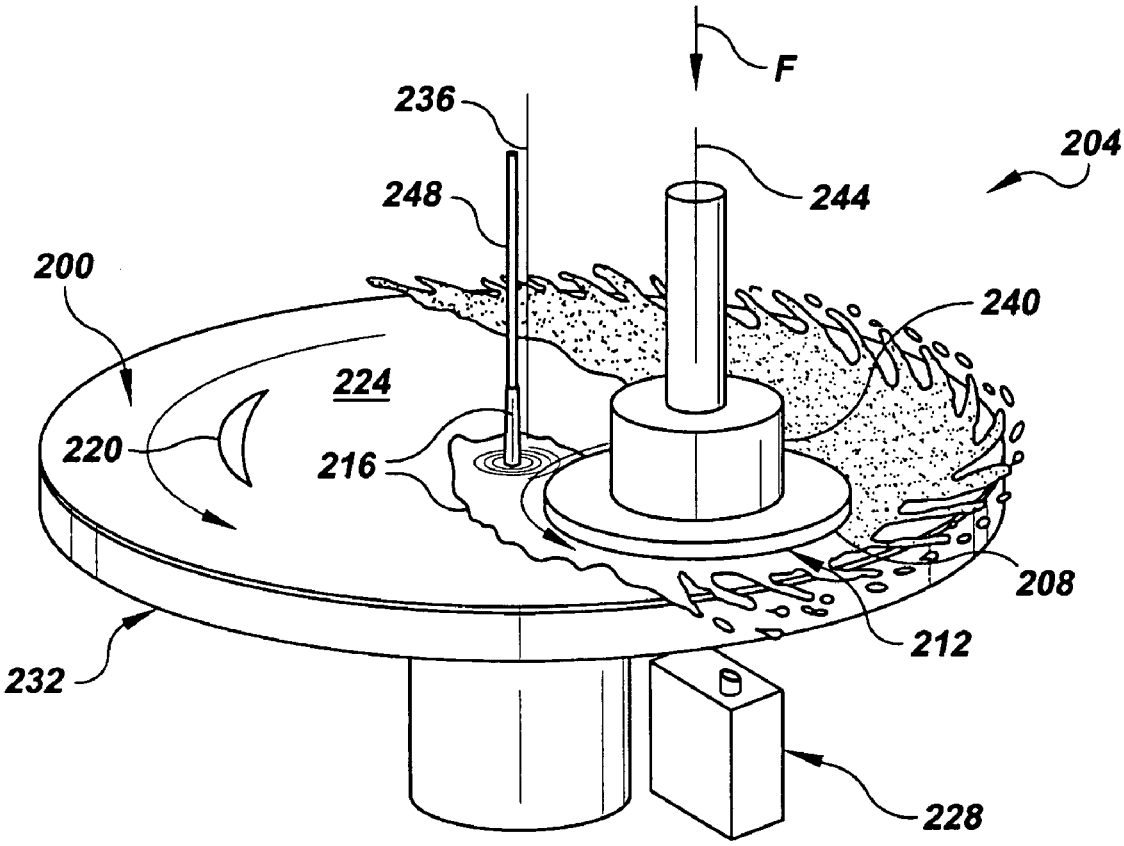
FIG. 2 is a perspective view of a portion of a dual-axis polisher and a polishing pad of the present invention.
Figure 4A:
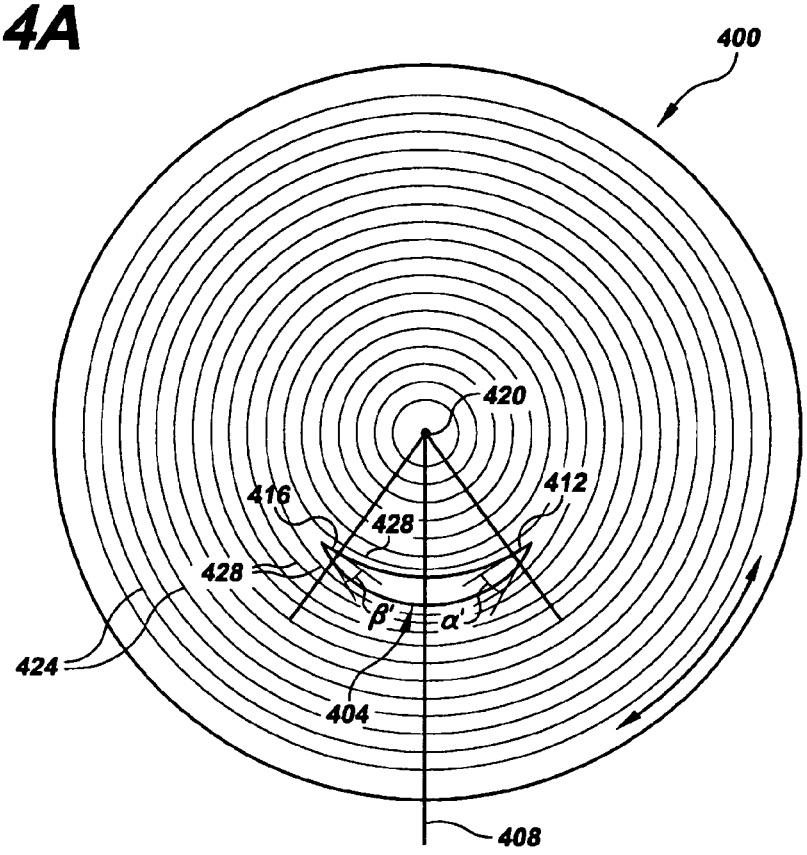
FIG. 4A is a plan view of an alternative rotary polishing pad of the present invention with a crescent-shaped window.

FIG. 4A shows another rotary polishing pad 400 made in accordance with the present invention that could be used for polishing pad 200 of FIG. 2. In this embodiment, windowpane 404 is symmetrical about a radial line 408 and half-width leading angle α' and half-width trailing angle β' are approximately 21°. Having leading and trailing ends 412, 416 both highly streamlined provides the additional benefit that polishing pad 400 may be rotated in either direction about rotational center 420 of the pad. In some embodiments this may be desirable to increase the flexibility in use of polishing pad 400. In particular, it is noted that some polishers may be set up to rotate a polishing pad in a counterclockwise direction, some so that the pad rotates in a clockwise direction, and some so that either a clockwise or counterclockwise rotation may be selected. This shape of windowpane 404 also provides the windowpane with a highly streamlined leading end 412. It is noted that half-width leading angle α' should be 5 to 150° as described above in connection with FIGS. 3A–3C and, likewise, are more preferably 10 to 120° and even more preferably 15 to 45°; and that half-width trailing angle β' should be 5 to 45°, 10 to 40° is more preferable, and 15 to 30° is even more preferable.

Like polishing pad 300 of FIGS. 3A–3C, it is preferred, but not necessary, that any grooves 424 provided to polishing pad 400 of FIG. 4A be diverted around windowpane 404 so as to reduce the disturbance to the flow of polishing medium (not shown) flowing in these grooves in the region proximate to the windowpane. In the embodiment shown, grooves 424 are circular, except the several grooves 428 proximate windowpane 404 that divert around the windowpane so as to provide a continuous flow channel for the polishing medium to readily flow around the windowpane. Similar to windowpane 320 of FIGS. 3A–3C, windowpane 404 may be provided in any suitable manner, such as the cut-and-insert and in-situ molding techniques described above. Polishing pad 400 and windowpane 404 may be made of any suitable material(s), such as the materials discussed above in connection with FIGS. 3A–3C.

Figure 4B:
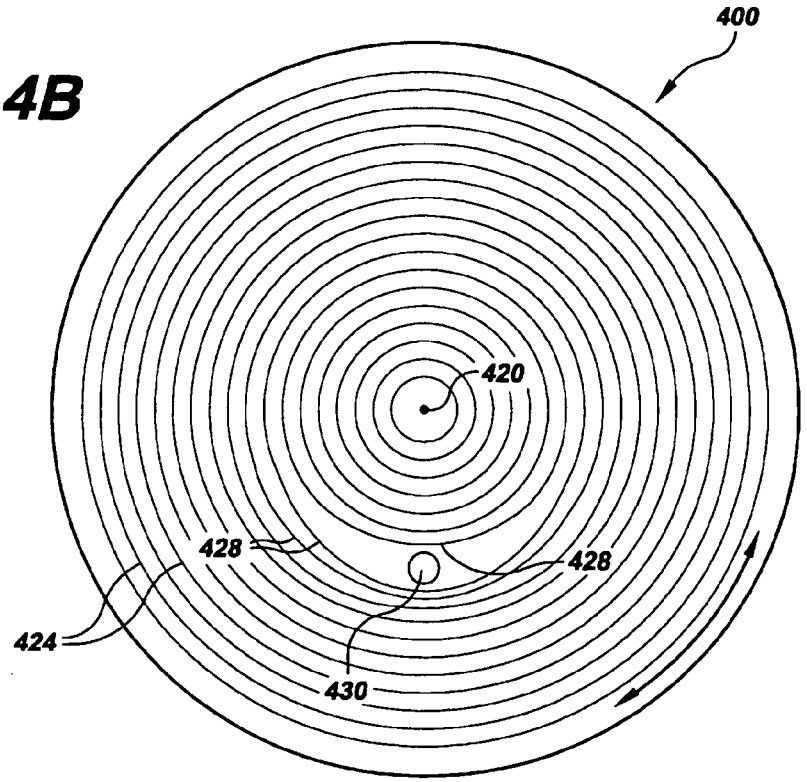
FIG. 4B is a plan view of an alternative rotary polishing pad of the present invention with a circular-shaped window.

FIG. 4B illustrates an alternative embodiment wherein grooves 428 divert around circular-shaped window 430. Unlike diverted grooves 428, circular grooves 424 remain circular with respect to center of rotation 420. Diverting grooves 428 around the window 430 reduces interaction between the polishing medium and the window 430. In addition, grooves 428 permit clockwise and counterclockwise rotation of rotary polishing pad 400. Alternatively, diverting grooves 428 may circumvent oval, square, rectangular, triangular or other shaped windows.

Figure 5:
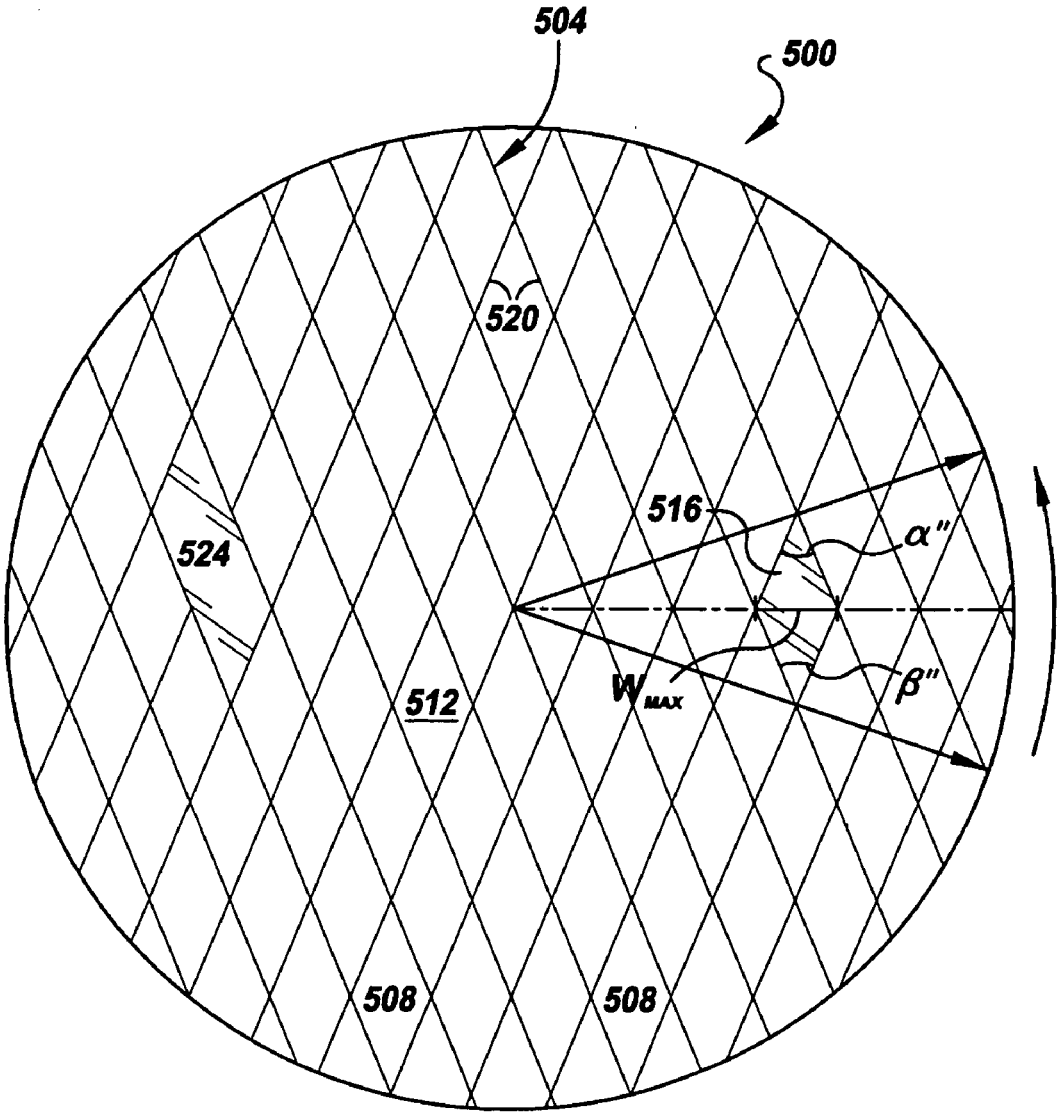
FIG. 5 is a plan view of another alternative rotary polishing pad of the present invention.

FIG. 5 illustrates another polishing pad 500 of the present invention. In this embodiment, polishing pad 500 includes a groove pattern 504 that may be considered to define a plurality of like-shaped land regions 508 of polishing surface 512. A windowpane 516 is located within groove pattern 504 so as to fall completely within one of land regions 508. In this particular embodiment, windowpane 516 conforms to the shape of the corresponding one of land regions 508 so as to essentially replace the entirety of that land region with the windowpane. In this case, grooves 520 immediately adjacent windowpane 516 may be considered to divert around the windowpane in conformance with regular groove pattern 504.

As a result of the particular placement of windowpane 516 in polishing pad 500, it is readily seen that the windowpane has a half-width leading angle α" of 45° and a half-width trailing angle β" also of 45°. With other groove patterns, windowpane shapes, and placements of windowpanes, other half-width leading and trailing angles α", β" are certainly possible. Because of the symmetrical shape of the window, it is desirable, though not necessary, that half-width leading and trailing angles α", β" of windowpane 516 be 5 to 45°, preferably 10 to 40°, and most preferably 15 to 30°.

FIG. 5 also illustrates an alternative windowpane 524 that occupies several land regions 508 so as to provide a larger windowpane, if needed. In this particular embodiment, it is noted that windowpane 524 conforms to the immediately adjacent grooves 520 of groove pattern 504, although it certainly could not in an alternative configuration (not shown). Like the ones of grooves 520 surrounding windowpane 516, the grooves surrounding windowpane 524 may be considered to be diverted around windowpane 524 in accordance with regular grid pattern 504. Polishing pad 500 and windowpanes 516, 524 may be made of any suitable material(s) and in any suitable manner, such as the materials and techniques described above in connection with polishing pad 300 of FIGS. 3A–3C. As those skilled in the art will appreciate, groove pattern 504 may be a pattern other than hexagonal, such as rectangular or rhomboidal, among others.

Figure 6A:
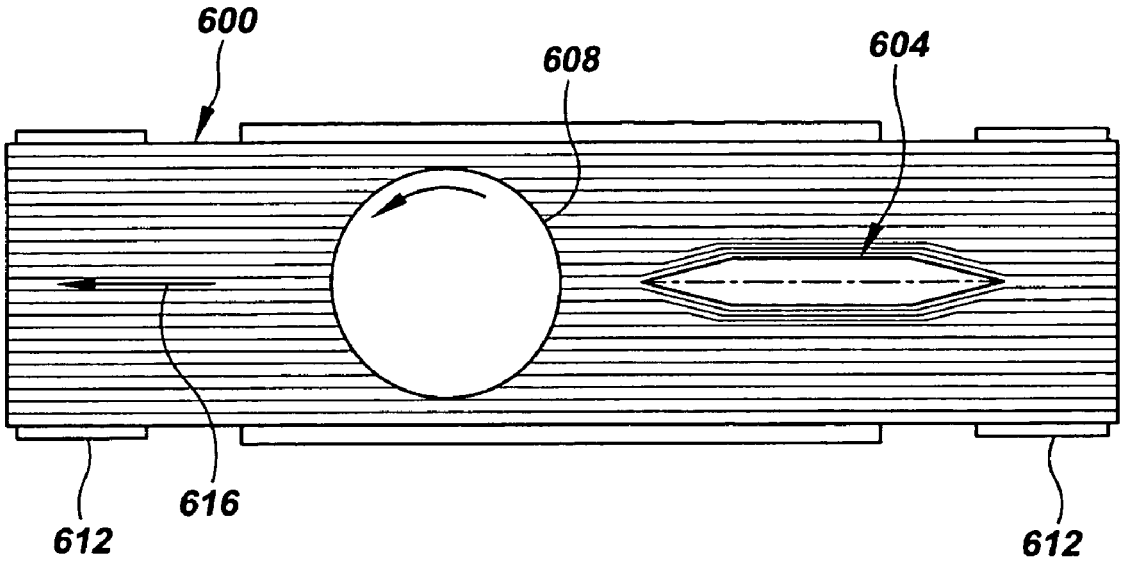
FIG. 6A is a plan view of a belt-type polishing pad of the present invention.
Figure 6B:
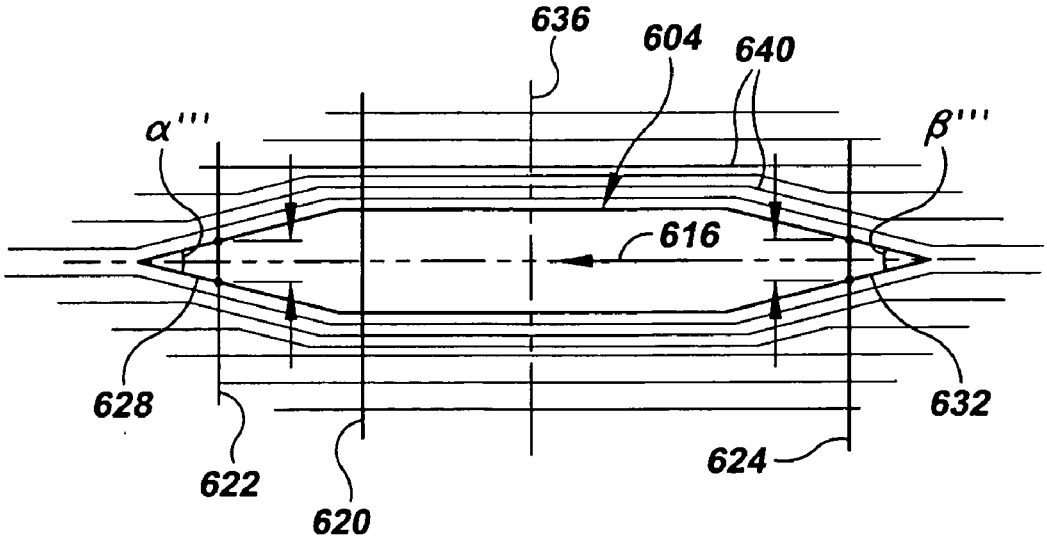
FIG. 6B is an enlarged plan view showing the windowpane of the polishing pad of FIG. 6A.

FIGS. 6A and 6B show a belt-type polishing pad 600 of the present invention that includes a windowpane 604 for allowing optical measurements to be made using light reflected from the polished surface of a wafer 608, or other object being polished using the pad. In this embodiment, windowpane 604 must be made of a relatively flexible translucent material so as to allow the windowpane to flex as it conforms to the cylindrical surfaces of a pair of rollers 612 as polishing pad 600 is moved relative to wafer 608 in a linear belt direction 616 by a suitable belt-driving mechanism (not shown). Essentially, the only difference between windowpane 604 of FIGS. 6A and 6B and windowpanes 320, 404 of FIGS. 3A–3C and 4 is that windowpane 604 of FIGS. 6A and 6B is not curved. Windowpanes 320, 404 of FIGS. 3A–3C and 4 are shown as being curved so as to conform to the circular paths that these windowpanes sweep out as polishing pads 300, 400 are rotated about their respective centers of rotation 308, 420. Since windowpane 604 of FIGS. 6A and 6B sweeps out a linear path as polishing pad 600 is moved in belt direction 616, the windowpane obviously need not be curved. Consequently, instead of determining maximum width $W'_{max}$ and half widths $W'_{1/2max}$ based on radial lines as with windowpanes 320, 404, these widths are determined relative to corresponding lines 620, 622, 624 that are each perpendicular to belt direction 616.

In the embodiment shown in FIGS. 6A and 6B, each of half-width leading angle $\alpha'''$ and half-width trailing angle $\beta'''$ of, respectively, leading end 628 and trailing end 632 of windowpane 604, is equal to 25°. Similar to rotary polishing pads 300, 400 and 500 discussed above, half-width leading angle $\alpha'''$ should be 5 to 150°, preferably 10 to 120°, and more preferably 15 to 45° and that half-width trailing angle $\beta'''$ should be 5 to 45°, 10 to 40° is more preferable, and 15 to 30° is even more preferable. In addition, windowpane 604 may be symmetrical about a line 636 perpendicular to belt direction 616. This is particularly desirable when polishing pad 600 could be moved as desired in either belt direction 616 or the opposite belt direction. Of course, windowpane 604 may also be symmetrical about a line parallel to belt direction 616. Materials for polishing pad 600 other than windowpane 604 may be any suitable material known to those skilled in the art, such as the materials mentioned above relative to polishing pad 300 of FIGS. 3A–3C. Like windowpane 320 of FIGS. 3A–3C, windowpane 604 of FIGS. 6A and 6B may be incorporated into polishing pad 600 in any suitable manner, such as the cut-and-insert or in-situ molding techniques described above.

Polishing pad 600 may include grooves, such as the longitudinal grooves 640 shown, that may further be diverted around windowpane 604 so as to provide continuous flow channels for polishing medium (not shown) in the region of the windowpane. In other embodiments, grooves 640 may have different configurations, such as diagonal or transverse relative to belt direction 616, or may form isolated land regions (not shown), e.g., the hexagonal land regions shown in FIG. 5, rectangular land regions, or rhomboidal land regions, among others. If grooves 640 are arranged so as to form isolated land regions, windowpane 604 may be made to fit within one or a group of contiguous land regions in a manner similar to windowpanes 516, 524 of FIGS. 5A and 5B.

The invention claimed is:

1. A polishing pad suitable for polishing at least one of magnetic, optical and semiconductor substrates, the polishing pad comprising:

(a) a body having a polishing surface and a back surface spaced from the polishing surface wherein the polishing surface includes a plurality of grooves, at least some of the grooves being diverted around the window; and (b) a window, extending through the body, comprising a translucent windowpane having a surface flush with the polishing surface and having a half-width leading angle of 5 to 150° and a half-width trailing angle of 5 to 45°.

2. The polishing pad according to claim 1, wherein the window further has a half-width leading angle less than 60°.

3. The polishing pad according to claim 1, wherein the half-width trailing angle is 10 to 40°.

4. The polishing pad according to claim 1, wherein the half-width trailing angle is 15 to 30°.

5. A polishing pad suitable for polishing at least one of magnetic, optical and semiconductor substrates, the polishing pad comprising:

(a) a body having a polishing surface and a back surface spaced from the polishing surface, the polishing surface comprising a plurality of grooves; and (b) a window, extending through the body, comprising a translucent windowpane having a surface flush with the polishing surface;

wherein at least some of the plurality of grooves divert around the window.

6. The polishing pad according to claim 5, wherein diverted ones of the plurality of grooves are circular except in a region where the diverted ones are diverted.

7. The polishing pad according to claim 5, wherein diverted ones of the plurality of grooves are linear except in a region wherein the diverted ones are diverted.

8. The polishing pad according to claim 5, wherein the plurality of grooves define a plurality of like-shaped land regions, the window occupying a plurality of contiguous ones of the plurality of like-shaped land regions.

9. A polishing pad suitable for polishing at least one of magnetic, optical and semiconductor substrates, the polishing pad comprising:

(a) a body having a polishing surface and a back surface spaced from the polishing surface, the polishing surface comprising a plurality of grooves; and (b) a window, extending through the body, comprising a translucent windowpane having a surface flush with the polishing surface and having a half-width trailing angle of 5 to 45°;

wherein at least some of the plurality of grooves are diverted around the window.

* * * * *